US010825620B2

(12) United States Patent
Hsieh

(10) Patent No.: US 10,825,620 B2
(45) Date of Patent: Nov. 3, 2020

(54) LIGHT GUIDING SUBSTRATE FOR A KEYBOARD

(71) Applicant: Chicony Electronics Co., Ltd., New Taipei (TW)

(72) Inventor: Chao-Chin Hsieh, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 16/230,214

(22) Filed: Dec. 21, 2018

(65) Prior Publication Data

US 2020/0051761 A1 Feb. 13, 2020

(30) Foreign Application Priority Data

Aug. 13, 2018 (TW) ..... 107128234 A

(51) Int. Cl.
*H01H 13/83* (2006.01)
*H01H 13/84* (2006.01)
*H01H 13/7065* (2006.01)

(52) U.S. Cl.
CPC ..... *H01H 13/83* (2013.01); *H01H 13/7065* (2013.01); *H01H 13/84* (2013.01); *H01H 2219/06* (2013.01); *H01H 2219/062* (2013.01); *H01H 2227/036* (2013.01)

(58) Field of Classification Search
CPC ..... H01H 2219/054; H01H 2219/06; H01H 2219/062; H01H 2219/044; H01H 2219/056; H01H 3/125; G06F 3/0202; G02B 6/0011; G02B 6/0055; H05K 2201/2054
See application file for complete search history.

(56) References Cited

U.S. PATENT DOCUMENTS 7,534,001 B2 * 5/2009 Liu ..... G02B 6/0016 362/23.03
7,709,760 B2 * 5/2010 Chen ..... G06F 3/0202 200/310

(Continued)

FOREIGN PATENT DOCUMENTS

CN 201654689 U 11/2010
TW 201742087 A 12/2017

*Primary Examiner* — Vanessa Girardi

(74) *Attorney, Agent, or Firm* — Muncy, Geissler, Olds & Lowe, P.C.

(57) ABSTRACT

An illuminated keyboard includes a light guiding substrate, a support plate, a plurality of keycaps, and a plurality of liftable connecting member. The light guiding substrate has an upper surface and a lower surface. The upper surface includes a plurality of assembly areas, each of the assembly areas has an assembly structure. The support plate is above the light guiding substrate, and the support plate has a top surface and a bottom surface. The support plate is provided with a plurality of first penetrated portions, each of the first penetrated portions corresponds to the corresponding assembly area, and each of the assembly structures passes through the corresponding first penetrated portion. The keycaps are above the support plate and corresponding to the assembly areas. Each of the liftable connecting members is connected to the corresponding keycap and the assembly structure of the corresponding assembly area.

17 Claims, 7 Drawing Sheets

(56) References Cited

U.S. PATENT DOCUMENTS

| | | | | |
|---|---|---|---|---|
| 8,530,768 | B2 * | 9/2013 | Hwa | H01H 13/83 200/310 |
| 9,984,839 | B2 * | 5/2018 | Wang | H01H 13/83 |
| 2004/0008505 | A1 * | 1/2004 | Chiang | G02B 6/0005 362/602 |

* cited by examiner

LIGHT GUIDING SUBSTRATE FOR A KEYBOARD

CROSS-REFERENCE TO RELATED APPLICATION

This non-provisional application claims priority under 35 U.S.C. § 119(a) to Patent Application No. 107128234 filed in Taiwan, R.O.C. on Aug. 13, 2018, the entire contents of which are hereby incorporated by reference.

BACKGROUND

Technical Field

The instant disclosure relates to a keyboard, in particular, to an illuminated keyboard.

Related Art

Keyboards are common input devices. Usually, they are used along with electronic devices, such as laptops, notebook computers, smart phones, tablets, etc. Moreover, illuminated keyboards with light emitting function are developed for being used in illumination-insufficient circumstances.

Currently, most illuminated keyboards utilize backlight modules as the light sources of the illuminated keyboards. Typically, the backlight module is assembled at the bottom of the keyboard for guiding the light emitting from the bottom portions of the keys upwardly. However, the light guiding structure of the backlight module has a complex plate structure formed by stacking a light shielding plate, a light guiding plate, and a light reflection plate. As a result, the assembly of the backlight module leads the overall thickness of the keyboard increasing.

SUMMARY

In view of this, in one embodiment of the instant disclosure, an illuminated keyboard is provided and the illuminated keyboard comprises a light guiding substrate, a support plate, a plurality of keycaps, and a plurality of liftable connecting members. The light guiding substrate comprises an upper surface and a lower surface opposite to the upper surface. The upper surface comprises a plurality of assembly areas. Each of the assembly areas has an assembly structure disposed thereon. The support plate is disposed above the light guiding substrate. The support plate comprises a top surface and a bottom surface opposite to the top surface. The support plate has a plurality of first penetrated portions respectively corresponding to the assembly areas. Each assembly structure passes through the corresponding first penetrated portion. The keycaps are disposed above the support plate and respectively correspond to the assembly areas. Each of the liftable connecting members is connected to the corresponding keycap and the assembly structure on the corresponding assembly area.

As above, in the illuminated keyboard of one or some embodiments of the instant disclosure, the light guiding substrate can be achieved via a one-layer plate without additional shielding plate(s) and reflection plate(s), so that the overall thickness of the illuminated keyboard can be reduced. Furthermore, the assembly structures for assembling with the liftable connecting members are disposed on the light guiding substrate, such that the thickness of the support plate can also be reduced, thereby further reducing the overall thickness of the illuminated keyboard.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
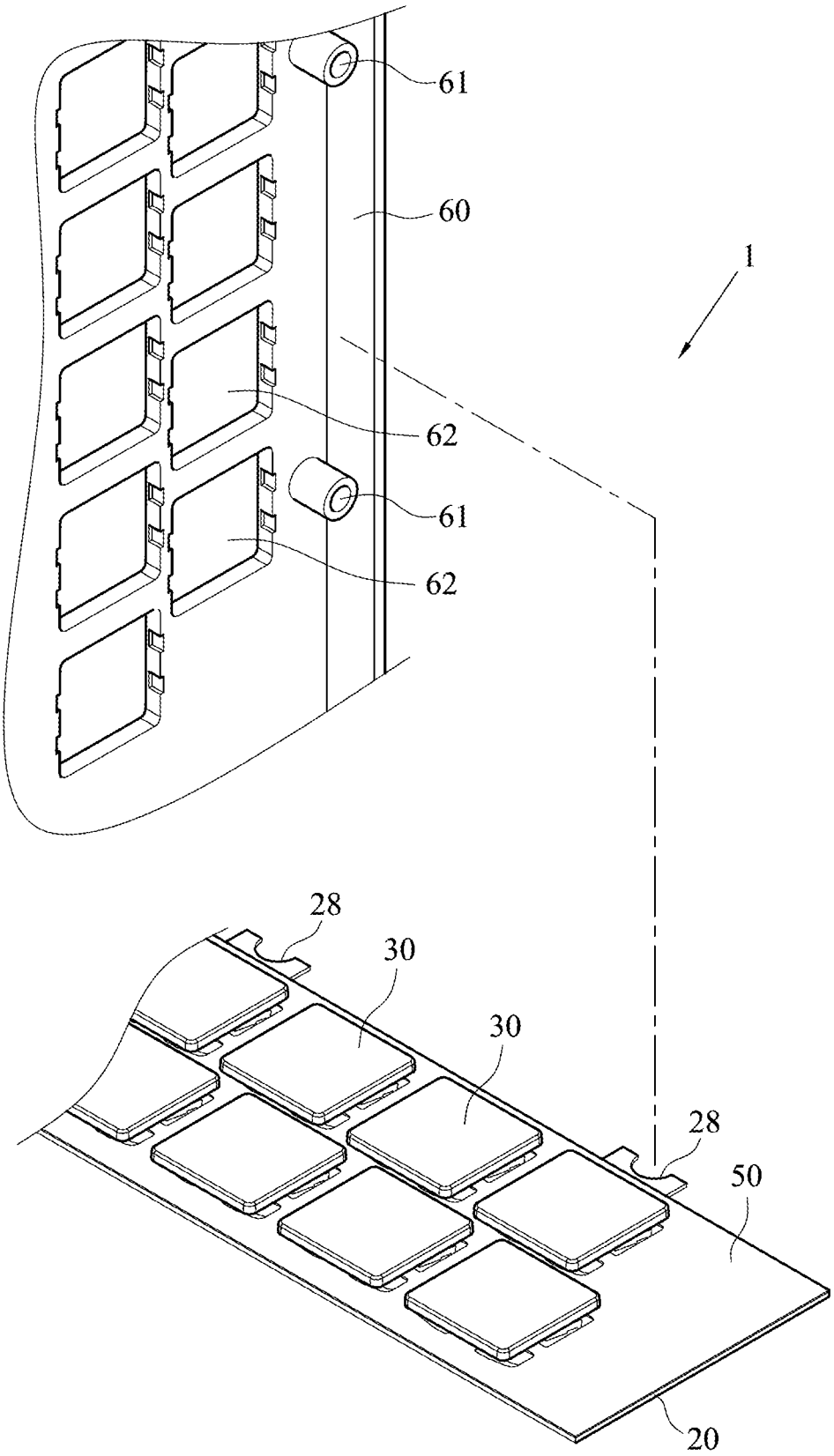
FIG. 1 illustrates a perspective view of an illuminated keyboard according to an exemplary embodiment of the instant disclosure.
Figure 2:
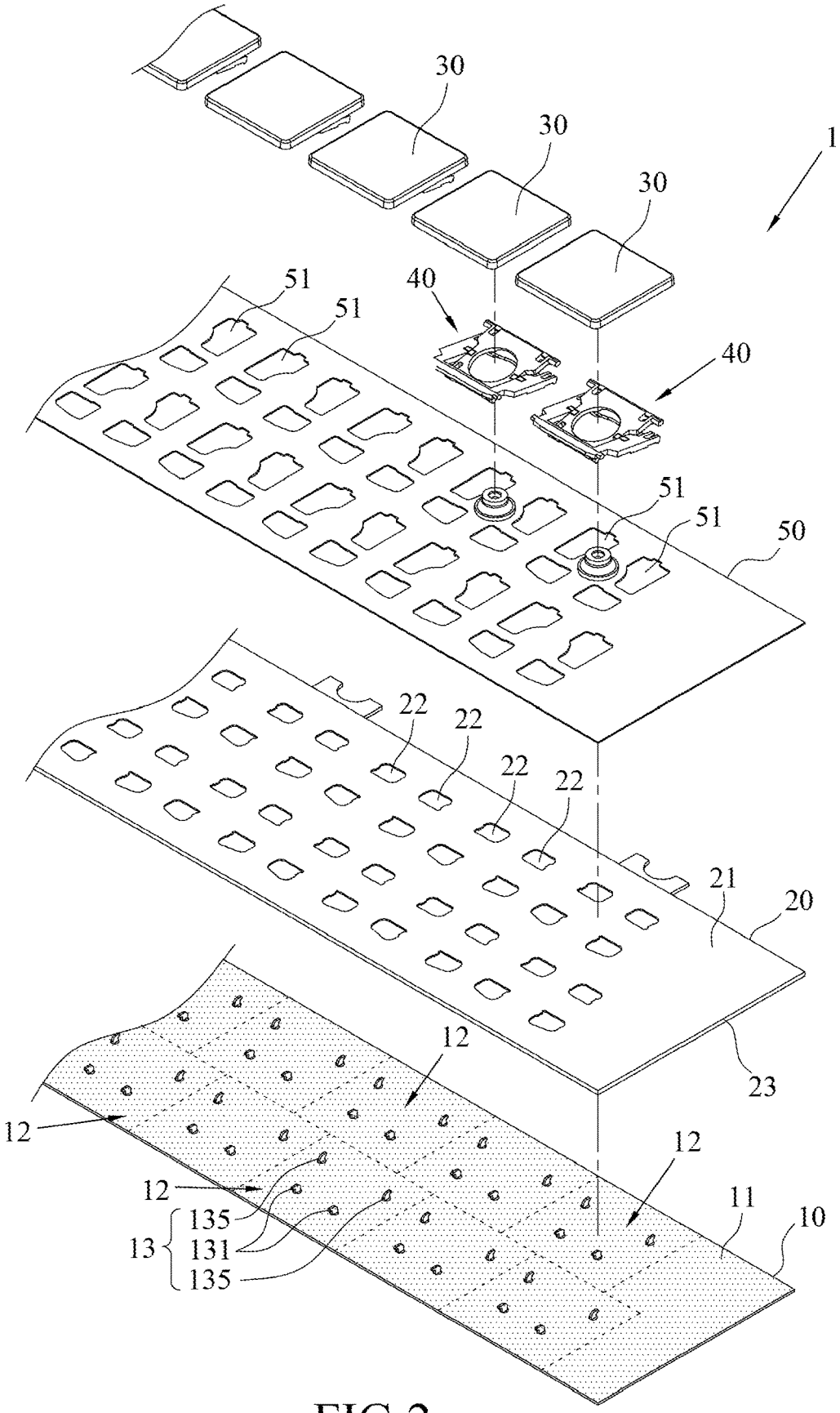
FIG. 2 illustrates an exploded view of the illuminated keyboard according to the exemplary embodiment.
Figure 3:
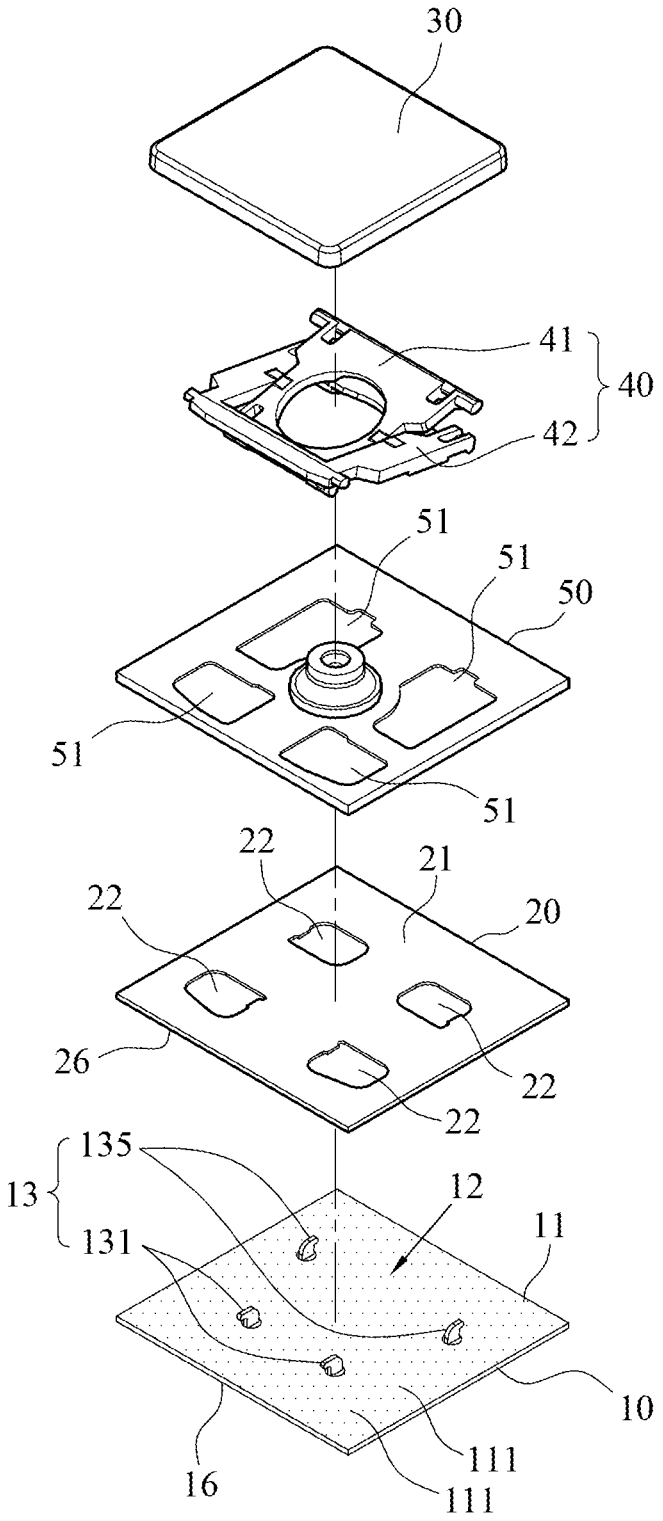
FIG. 3 illustrates a partial exploded view of the illuminated keyboard according to the exemplary embodiment.
Figure 4:
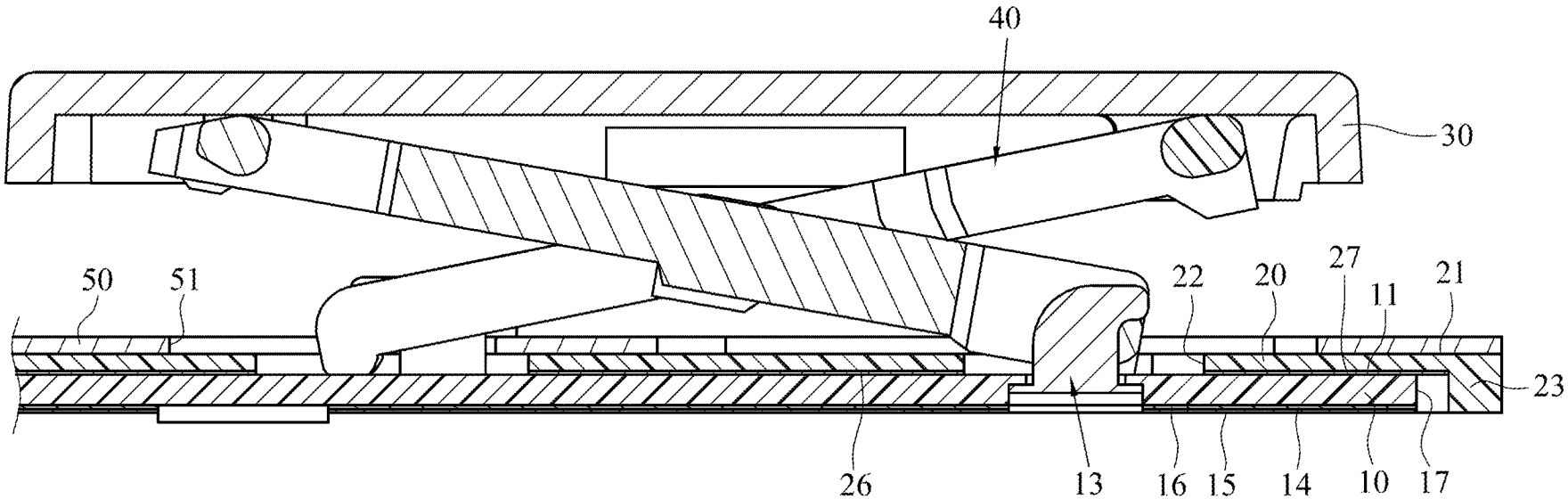
FIG. 4 illustrates a partial sectional view of the illuminated keyboard according to the exemplary embodiment.

FIG. 1 illustrates a perspective view of an illuminated keyboard according to an exemplary embodiment of the instant disclosure. FIG. 2 illustrates an exploded view of the illuminated keyboard of the exemplary embodiment. FIG. 3 illustrates a partial exploded view of the illuminated keyboard of the exemplary embodiment. FIG. 4 illustrates a partial sectional view of the illuminated keyboard of the exemplary embodiment. As shown in FIGS. 1 and 2, an illuminated keyboard 1 in this embodiment comprises a light guiding substrate 10, a support plate 20, a plurality of keycaps 30, a plurality of liftable connecting members 40, and a circuit board 50. The support plate 20 is disposed above the light guiding substrate 10; the circuit board 50 is disposed on the support plate 20; the keycaps 30 are disposed above the circuit board 50. The liftable connecting members 40 are disposed between the keycaps 30 and the circuit board 50 for connecting the keycaps 30 and the light guiding substrate 10, such that the keycaps 30 can be moved up and down relative to the circuit board 50.

As shown in FIGS. 2 and 3, the light guiding substrate 10 can be made of light guiding materials to have a light guiding function. For example, the light guiding substrate 10 may be a plate made of polycarbonate (PC), poly(methyl methacrylate) (PMMA), or glass materials. The light guiding substrate 10 comprises an upper surface 11 and a lower surface 16 opposite to the upper surface 11. The upper surface 11 has a plurality of assembly areas 12, and the assembly areas 12 are areas on the light guiding substrate 10 for assembling with the keycaps 30 respectively (for example, in FIG. 2, the assembly areas 12 are indicated by frames with dashed line). Each assembly area 12 of the light guiding substrate 10 has an assembly structure 13 disposed thereon for connecting with the corresponding liftable connecting member 40.

As shown in FIGS. 2 to 4, the support plate 20 may be a hard plate made of metal (e.g., aluminum, steel, or alloy(s)) or plastic to have a supporting function. That is, the support plate 20 is configured to support components of the illuminated keyboard 1 (e.g., the light guiding substrate 10, the keycaps 30, the liftable connecting members 40, and the circuit board 50) in direct or indirect manners. The circuit board 50 may be a printed circuit board (PCB), a flexible printed circuit board (FPCB), a Rigid-Flex PCB, or other types of circuit boards. In this embodiment, the support plate 20 is stacked on the light guiding substrate 10, and the circuit board 50 is stacked on the support plate 20.

As shown in FIGS. 2 to 4, in this embodiment, the support plate 20 comprises a top surface 21 and a bottom surface 26 opposite to the top surface. The bottom surface 26 faces the upper surface 11 of the light guiding substrate 10. The support plate 20 has a plurality of first penetrated portions 22, and the first penetrated portions 22 respectively correspond to the assembly areas 12. The circuit board 50 has a plurality of second penetrated portions 51, and the second penetrated portions 51 respectively correspond to the first penetrated portion 22 of the support plate 20. Each assembly structure 13 of the light guiding substrate 10 passes through the corresponding first penetrated portion 22 and the corresponding second penetrated portion 51 and upwardly protrudes out of the top surface 21 of the support plate 20. Therefore, the liftable connecting members 40 can be assembled with the assembly structures 13 smoothly.

As shown in FIGS. 2 to 4, in an exemplary embodiment, the assembly structure 13 of each assembly area 12 of the light guiding substrate 10 may comprise at least one assembly member for connecting with the liftable connecting members 40. For example, in this embodiment, each of the liftable connecting members 40 is a cross-type connecting member and comprises an inner frame 41 and an outer frame 42 pivoted with each other. The assembly structure 13 of each assembly area 12 of the light guiding substrate 10 comprises a plurality of first hooks 131 (in this embodiment, two first hooks 131) and a plurality of second hooks 135 (in this embodiment, two second hooks 135) as assembly members. The plurality of the first hooks 131 and the plurality of the second hooks 135 are located at opposite sides of the assembly area 12. The first penetrated portions 22 of the support plate 20 each have a plurality of holes, and the second penetrated portions 51 of the circuit board 50 each have a plurality of holes, such that the first hooks 131 and the second hooks 135 pass through the holes of the support plate 20 and the holes of the circuit board 50. For each of the liftable connecting members 40 and the corresponding assembly structure 13, the inner frame 41 is assembled with the first hooks 131, and the outer frame 42 is assembled with the second hooks 135.

In one embodiment, one of two ends of the inner frame 41 of the liftable connecting member 40 is slidably pivoted with the corresponding first hooks 131, and the other end of the inner frame 41 is pivoted on a bottom portion of the corresponding keycap 30; one of two ends of the outer frame 42 of the liftable connecting member 40 is slidably pivoted with the corresponding second hooks 135, and the other end of the outer frame 42 is pivoted on the bottom portion of the corresponding keycap 30. Accordingly, when the keycap 30 is pressed, the keycap 30 can be moved up and down relative to the circuit board 50 via the guiding of the liftable connecting member 40.

In some embodiments, one of two ends of the inner frame 41 of the liftable connecting member 40 is pivoted on the corresponding assembly structure 13, and the other end of the inner frame 41 is slidably pivoted on the bottom portion of the corresponding keycap 30; one of two ends of the outer frame 42 of the liftable connecting member 40 is pivoted on the corresponding assembly structure 13, and the other end of the outer frame 42 is slidably pivoted on the bottom portion of the corresponding keycap 30. However, it is understood that, the foregoing embodiments are provided as illustrative purposes and instant disclosure is not limited thereto; for example, the liftable connecting members 40 may be connecting members in other types (e.g., butterfly-type connecting members).

Figure 5:
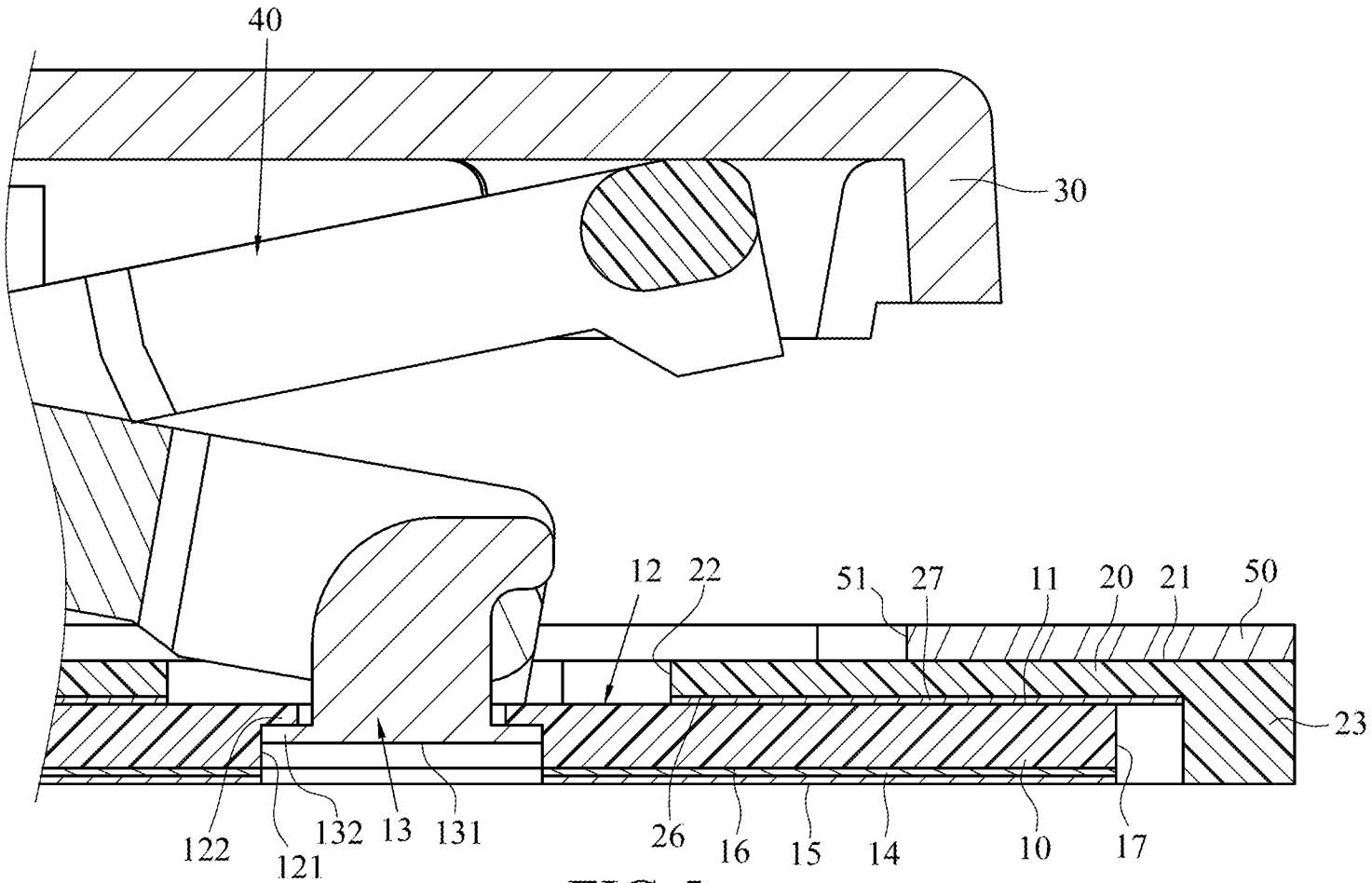
FIG. 5 illustrates an enlarged partial sectional view of the illuminated keyboard according to the exemplary embodiment.

Further, as shown in FIGS. 4 and 5, the bottom surface 26 of the support plate 20 has a first light reflection layer 27 disposed thereon and covering the upper surface 11 of the light guiding substrate 10. In some embodiments, the first light reflection layer 27 may be a pale-colored ink layer and the ink layer is printed or coated on the bottom surface 26 of the support plate 20. For example, the color of the ink layer may be white, silver, golden, pale blue, pale green, pale yellow, or pale gray to have the light reflection function. Alternatively, the first light reflection layer 27 may be a pale-colored glue layer. For example, the color of the glue layer may be white, silver, golden, pale blue, pale green, pale yellow, or pale gray. In this case, the first light reflection layer 27 not only has the light reflection function, but also the first light reflection layer 27 can be used for gluing the support plate 20 and the light guiding substrate 10 with each other. In another embodiment, the first light reflection layer 27 may be a pale-colored thin film layer. For example, the thin film layer may be a glass reflection film, a PET reflection film, a PVC reflection film, or other thin films in pale color. In some embodiments, the thin film layer may be fixed on the bottom surface 26 of the support plate 20 by ways of gluing, hot-melting, adhering, etc.

Figure 6:
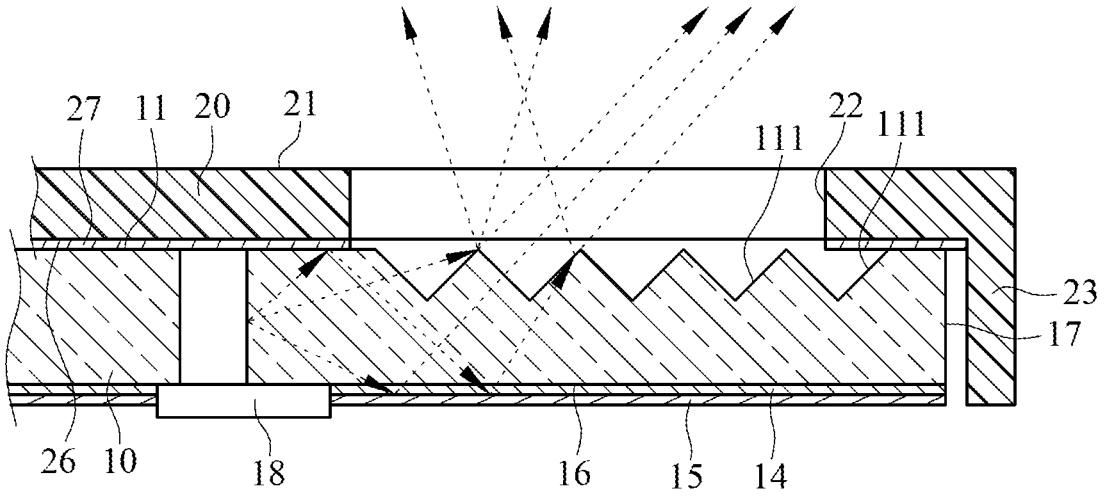
FIG. 6 illustrates a schematic view showing the light guiding scenario of the illuminated keyboard according to the exemplary embodiment.

Accordingly, when an external light enters into the light guiding substrate 10, the light is reflected within the light guiding substrate 10 via the first light reflection layer 27 at the bottom surface 26 of the support plate 20. Please refer to FIGS. 5 and 6. FIG. 6 illustrates a schematic view showing the light guiding scenario of the illuminated keyboard 1 according to the exemplary embodiment. In this embodiment, one side of the light guiding substrate 10 has a light emitting member 18 (e.g., an LED light source, a fluorescent light source, or an infrared light source) for illuminating on the light guiding substrate 10. When the light enters into the light guiding substrate 10, the light which is upwardly transmitted to the bottom surface of the support plate 20 can be reflected back to the light guiding substrate 10 by the first light reflection layer 27; so that the light can be concentrated, and then emitted from the first penetrated portions 22 of the support plate 20 and the second penetrated portions 51 of the circuit board 50, and illuminating on the keycaps 30. The keycaps 30 each may be formed with a light permeable area (e.g., a text area or a figure area). Therefore, for each of the keycaps 30, when the light emitted from the corresponding first penetrated portion 22 of the support plate 20 and the corresponding second penetrated portion 51 of the circuit board 50 illuminates on the keycap 30, the light permeable area of the keycap 30 emits light outwardly, so that the illuminated keyboard 1 can be used in insufficient illumination circumstances.

As above, in the illuminated keyboard 1 of one or some embodiments of the instant disclosure, the bottom surface 26 of the support plate 20 has the first light reflection layer 27 for covering the upper surface 11 of the light guiding substrate 10. Hence, as compared with the backlight module of a keyboard known to the inventor, the backlight function of the keyboard can be achieved via a one-layer plate (e.g., the light guiding substrate 10), so that the overall thickness of the illuminated keyboard 1 can be reduced. Furthermore, the assembly structures 13 for assembling with the liftable connecting members 40 are disposed on the light guiding substrate 10, such that the thickness of the support plate 20 can also be reduced, thereby further reducing the overall thickness of the illuminated keyboard 1. In detail, since it is not necessary to process the support plate 20 (e.g., via bending or punching) to have structures for assembling with the liftable connecting members 40, the thickness of the support plate 20 can be reduced. For example, the thickness of the support plate 20 may be less than the thickness of the light guiding substrate 10 (as shown in FIG. 5), so that the overall thickness of the illuminated keyboard 1 can be further reduced.

In one or some embodiments, the upper surface 11 of the light guiding substrate 10 has a light guiding micro-structure 111, so that the light guiding substrate 10 can emit light uniformly. As shown in FIGS. 3 and 6, in this embodiment, the light guiding micro-structure 111 is a plurality of light guiding spots; these light guiding spots may be formed on the upper surface 11 of the light guiding substrate 10 via ways of laser engraving, grid engraving, imprinting, printing (e.g., UV screen printing), etc. When the light illuminates on the light guiding spots, the light can be directed toward various angles for improving the uniformity of light illumination. Furthermore, in this embodiment, the light guiding micro-structure 111 is disposed on the upper surface 11 of the light guiding substrate 10, such that the light guiding micro-structure 111 can be close to the keycap 30. Therefore, the light directed by the light guiding micro-structure 111 can be transmitted to the keycaps 30 with a short distance to reduce energy loss and to improve the light emitting efficiency. In some other embodiments, the light guiding micro-structure 111 may be a plurality of light guiding lines or may be the combination of light guiding lines and light guiding spots, embodiments are not limited thereto.

As shown in FIGS. 4 to 6, in one embodiment, the support plate 20 is formed with a light shielding plate 23 downwardly extending from a periphery of the support plate 20, and the light shielding plate 23 covers a side surface 17 of the light guiding substrate 10, so that the periphery of the light guiding substrate 10 can be shielded. Therefore, the light does not leak from the side surface 17 of the light guiding substrate 10 and the light emitting efficiency can be improved. In this embodiment, the light shielding plate 23 is integrally formed with the support plate 20 and downwardly extending from the periphery of the support plate 20, but embodiments are not limited thereto.

As shown in FIGS. 4 to 6, in one embodiment, the lower surface 11 of the light guiding substrate 10 has a second light reflection layer 14 and a light shielding layer 15 disposed thereon. The second light reflection layer 14 is disposed between the light guiding substrate 10 and the light shielding layer 15. Accordingly, as shown in FIG. 6, when the light enters into the light guiding substrate 10, the downwardly transmitted light can be reflected back to the light guiding substrate 10 by the second light reflection layer 14. Furthermore, the light shielding layer 15 prevents the light from leaking out of the light guiding substrate 10. Therefore, the light can be concentrated and then emitted upwardly from the first penetrated portions 22 of the support plate 20 and the second penetrated portions 51 of the circuit board 50 to improve the light emitting efficiency.

As shown in FIGS. 4 to 6, in some embodiments, the second light reflection layer 14 may be a pale-colored ink layer and the ink layer is printed or coated on the lower surface 11 of the light guiding substrate 10. For example, the color of the ink layer may be white, silver, golden, pale blue, pale green, pale yellow, or pale gray to have light reflection function. Alternatively, the second light reflection layer 14 may be a pale-colored glue layer. For example, the color of the glue layer may be white, silver, golden, pale blue, pale green, pale yellow, or pale gray. In this case, the second light reflection layer 14 not only has the light reflection function, but also the second light reflection layer 14 can be used for gluing the light shielding layer 15 and the light guiding substrate 10 with each other. In another embodiment, the second light reflection layer 14 may be a pale-colored thin film layer. For example, the thin film layer may be a glass reflection film, a PEF reflection film, a PVC reflection film, or other thin films in pale color. In some embodiments, the thin film layer may be fixed on the lower surface 11 of the light guiding substrate 10 by ways of gluing, hot-melting, adhering, etc.

As shown in FIGS. 4 to 6, in some embodiments, the light shielding layer 15 may be a dark-colored ink layer, and the ink layer is printed or coated on the outer surface of the second light reflection layer 14. For example, the color the dark-colored ink layer may be black, brown, or coffee. Alternatively, the light shielding layer 15 may be a dark-colored plastic sheet and the plastic sheet is fixed on the outer surface of the second light reflection layer 14 by ways of gluing, hot-melting, adhering, etc.

In one embodiment, each of the assembly structures 13 of the light guiding substrate 10 is configured to be assembled on the corresponding assembly area 12 to be fixed on the corresponding assembly area 12. For example, each of the assembly structures 13 may be fixed on the corresponding assembly area 12 of the light guiding substrate 10 by ways of gluing, hot-melting, adhering, in-mold injection, double injection, etc. As shown in FIGS. 4 and 5, in this embodiment, each of the assembly areas 12 of the light guiding substrate 10 has at least one through hole 121, and a radial flange 122 is protruding from an inner wall of each of the through holes 121. A shoulder portion 132 is protruding from a periphery of the bottom portion of the assembly member (in this embodiment, the first hook 131 is provided as an example of the assembly member) of the assembly structure 13. The first hook 131 passes through the through hole 121, and the shoulder portion 132 of the first hook 131 is abutted against the radial flange 122, so that the assembly structure 13 can be properly fixed with the assembly area 12, and the assembly between the assembly structure 13 and the assembly area 12 can be achieved in a convenient manner. That is, when an operator assembles the assembly structure 13 with the assembly area 12, the assembly structure 13 is firstly inserted into the through hole 121 and the shoulder portion 132 is abutted against the radial flange 122, so that the assembly structure 13 can be limited with the assembly structure 12 in advance. Hence, the subsequent assembly procedures for the assembly structure 13 can be performed conveniently.

Figure 7:
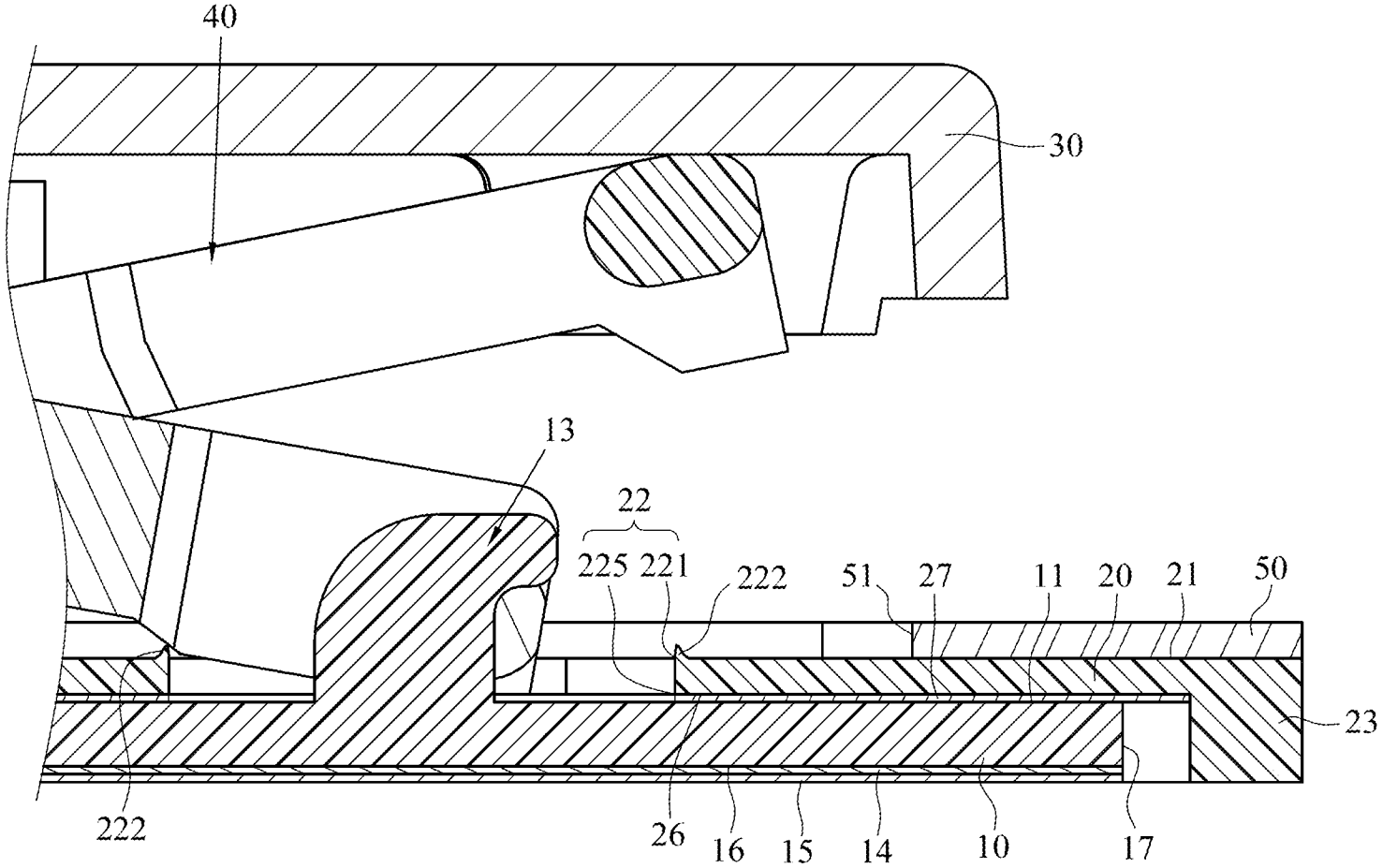
FIG. 7 illustrates an enlarged partial sectional view of the illuminated keyboard according to another exemplary embodiment of the instant disclosure.

In another embodiment, the assembly structures 13 and the light guiding substrate 10 may be integrally formed. For example, as shown in FIG. 7, the light guiding substrate 10 and the assembly structures 13 may all be made of a light guiding material and integrally formed with each other. Therefore, the structural strength of the assembly structures 13 can be further improved and the assembly procedures for the illuminated keyboard 1 can be reduced. Furthermore, when the light enters into the light guiding substrate 10, light in the light guiding substrate 10 of the embodiment shown in FIG. 7 can be further guided to the assembly structures 13, so that the assembly structures 13 can emit light, and the overall light emitting efficiency of the illuminated keyboard 1 can increase. In other embodiments, the plurality of the assembly structures 13 may be made of light guiding materials separately, and then the assembly structures 13 are assembled on the assembly areas 12 of the light guiding substrate 10, embodiments are not limited thereto.

As shown in FIG. 7, in one embodiment, each of the first penetrated portions 22 of the support plate 20 comprises an upper edge 221 and a lower edge 225 opposite to the upper edge 221. The upper edge 221 is adjacently connected to the top surface 21 and has a burrs structure 222, and the lower edge 225 is adjacently connected to the bottom surface 26. In an specific example, during the operator performs a punching procedure for forming the first penetrated portions 22, the support plate 20 is punched in a direction from the bottom surface 26 toward the top surface 21 to form holes, so that the burrs structures 222 are formed on the upper edges 221 of the first penetrated portions 21 in which the upper edges 221 are adjacently connected to the top surface 21. Therefore, such configuration prevents the burrs structures 222 of the support plate 20 from damaging the light guiding substrate 10.

Further, as shown in FIG. 1, the illuminated keyboard 1 may comprise a cover plate 60 covering the support plate 20. The cover plate 60 comprises a plurality of openings 62, and the openings 62 correspond to the keycaps 30. The cover plate 60 covers the support plate 20, and the keycaps 30 are protruding out of the openings 62 and exposed from the cover plate 60 for user operation.

In some embodiments, the cover plate 60 may be assembled with the support plate 20 or the light guiding substrate 10, so that the cover plate 60 can be fixed with the support plate 20 or the light guiding substrate 10. For example, the cover plate 60 may include a first assembly portion, the support plate 20 or the light guiding substrate 10 may include a second assembly portion, and the first assembly portion of the cover plate 60 is assembled with the second assembly portion. As shown in FIG. 1, in this embodiment, a first assembly portion 61 is disposed on the bottom portion of the cover plate 60 and comprises a plurality lock holes, the support plate 20 includes a second assembly portion 28. In this embodiment, the second assembly portion 28 is an assembly of several lock pieces located at one side of the support plate 20 and corresponding to the first assembly portion 61. Accordingly, in this embodiment, screws are provided to lock the first assembly portion 61 with the second assembly portion 28, so that the cover plate 60 is fixed on the support plate 20. In this embodiment, the cover plate 60 is fixed on the support plate 20, so the overall structural strength of the illuminated keyboard 1 can be improved. Such configuration also prevents the cover plate 60 from damaging the light guiding substrate 10 to affect the light guiding performance.

In some embodiments, the cover plate 60 may be assembled on the light guiding substrate 10, so that the cover plate 60 can be fixed with the light guiding substrate 10. For example, the second assembly portion for assembling with the first assembly portion of the cover plate 60 may be configured on the light guiding substrate 10, so that the cover plate 60 can be assembled with the light guiding substrate 10. Therefore, such configuration facilitates the thickness reduction of the support plate 20, further reducing the overall thickness of the illuminated keyboard 1.

As above, in the illuminated keyboard of one or some embodiments of the instant disclosure, the bottom surface of the support plate has the first light reflection layer for covering the upper surface of the light guiding substrate. Hence, the light guiding substrate can be achieved via a one-layer plate without additional shielding plate(s) and reflection plate(s), so that the overall thickness of the illuminated keyboard can be reduced. Furthermore, the assembly structures for assembling with the liftable connecting members are disposed on the light guiding substrate, such that the thickness of the support plate can also be reduced, thereby further reducing the overall thickness of the illuminated keyboard.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An illuminated keyboard, comprising:

a light guiding substrate comprising an upper surface and a lower surface opposite to the upper surface, the upper surface comprising a plurality of assembly areas, and each of the assembly areas having an assembly structure disposed thereon, wherein each of the assembly areas of the light guiding substrate has at least one through hole, each of the assembly structures comprises at least one assembly member passing through the through hole;

a support plate disposed above the light guiding substrate, the support plate comprising a top surface and a bottom surface opposite to the top surface, wherein the support plate has a plurality of first penetrated portions respectively corresponding to the assembly areas, and each of the assembly structures passes through the corresponding first penetrated portion;

a plurality of keycaps disposed above the support plate and respectively corresponding to the assembly areas; and a plurality of liftable connecting members, each of the liftable connecting members being connected to the corresponding keycap and the assembly structure on the corresponding assembly area;

wherein each of the assembly areas of the light guiding substrate is formed with a radial flange protruding from an inner wall of the through hole, the assembly member is formed with a shoulder portion protruding from a periphery of a bottom portion of the assembly member, and the shoulder portion is abutted against the radial flange.

2. The illuminated keyboard according to claim 1, wherein the assembly structures each are configured to be assembled on the corresponding assembly area.

3. The illuminated keyboard according to claim 1, wherein the assembly structures and the light guiding substrate are integrally formed.

4. The illuminated keyboard according to claim 1, wherein the assembly structures are made of a light guiding material.

5. The illuminated keyboard according to claim 1, wherein the support plate is formed with a light shielding plate downwardly extending from a periphery of the support plate, and the light shielding plate covers a side surface of the light guiding substrate.

6. The illuminated keyboard according to claim 1, wherein the thickness of the support plate is less than the thickness of the light guiding substrate.

7. The illuminated keyboard according to claim 1, wherein each of the first penetrated portions comprises an upper edge and a lower edge opposite to the upper edge, the upper edge is adjacently connected to the top surface and has a burrs structure, and the lower edge is adjacently connected to the bottom surface.

8. The illuminated keyboard according to claim 1, where each of the assembly structures passes through the corresponding first penetrated portion and upwardly protrudes out of the top surface of the support plate.

9. The illuminated keyboard according to claim 1, further comprising a cover plate covering the support plate, wherein the cover plate comprises a plurality of openings, the openings correspond to the keycaps to expose the keycaps, and the covering plate is assembled with the support plate or the light guiding substrate.

10. The illuminated keyboard according to claim 1, further comprising a circuit board disposed on the support plate, wherein the circuit board has a plurality of second penetrated portions respectively corresponding to the assembly areas, each of the assembly structures further passes through the corresponding second penetrated portion and upwardly protrudes out of the top surface of the support plate.

11. The illuminated keyboard according to claim 10, wherein each of the liftable connecting members comprises an inner frame and an outer frame pivoted with each other, each of the assembly structures comprises a plurality of first hooks and a plurality of second hooks, the plurality of the first hooks and the plurality of the second hooks are located at opposite sides of the corresponding assembly area, the inner frame is assembled with the first hooks, and the outer frame is assembled with the second hooks.

12. The illuminated keyboard according to claim 1, wherein the bottom surface of the support plate has a first light reflection layer disposed thereon and covering the upper surface of the light guiding substrate.

13. The illuminated keyboard according to claim 12, wherein the first light reflection layer is a pale-colored ink layer, a pale-colored glue layer, or a pale-colored thin film layer.

14. The illuminated keyboard according to claim 12, wherein the lower surface of the light guiding substrate has a second light reflection layer disposed thereon.

15. The illuminated keyboard according to claim 14, wherein the lower surface of the light guiding substrate further has a light shielding layer disposed thereon, and the second light reflection layer is disposed between the light guiding substrate and the light shielding layer.

16. The illuminated keyboard according to claim 15, wherein the upper surface of the light guiding substrate has a light guiding micro-structure.

17. The illuminated keyboard according to claim 15, wherein the light guiding micro-structure includes a plurality of light guiding spots or light guiding lines.

* * * * *